US009879347B2

(12) United States Patent
Bares et al.

(10) Patent No.: US 9,879,347 B2
(45) Date of Patent: Jan. 30, 2018

(54) METHOD FOR THE SURFACE TREATMENT OF PARTS MADE OF AN ALUMINUM OR MAGNESIUM ALLOY

(71) Applicant: MECAPROTEC INDUSTRIES, Muret (FR)

(72) Inventors: Pierre Bares, Mondavezan (FR); Cedric Stephan, Saint Renan (FR); Celine Gazeau, Rodez (FR)

(73) Assignee: MECAPROTEC INDUSTRIES, Muret (FR)

( * ) Notice: Subject to any disclaimer, the term of this patent is extended or adjusted under 35 U.S.C. 154(b) by 240 days.

(21) Appl. No.: 14/377,849

(22) PCT Filed: Feb. 11, 2013

(86) PCT No.: PCT/EP2013/052701

§ 371 (c)(1),
(2) Date: Aug. 9, 2014

(87) PCT Pub. No.: WO2013/117767

PCT Pub. Date: Aug. 15, 2013

(65) Prior Publication Data

US 2015/0020925 A1 Jan. 22, 2015

(30) Foreign Application Priority Data

Feb. 10, 2012 (FR) ..... 12 51268

(51) Int. Cl.

| | |
|---|---|
| ***C23C 22/83*** | (2006.01) |
| ***C23C 22/56*** | (2006.01) |
| ***C23C 22/34*** | (2006.01) |
| ***C25D 11/18*** | (2006.01) |
| ***C25D 11/04*** | (2006.01) |
| ***C25D 11/30*** | (2006.01) |
| ***C23C 22/57*** | (2006.01) |
| ***C23G 1/00*** | (2006.01) |
| *C23C 22/00* | (2006.01) |
| *C25D 11/24* | (2006.01) |

(52) U.S. Cl.

CPC ..... *C23C 22/56* (2013.01); *C23C 22/34* (2013.01); *C23C 22/57* (2013.01); *C23C 22/83* (2013.01); *C23G 1/00* (2013.01); *C25D 11/04* (2013.01); *C25D 11/18* (2013.01); *C25D 11/30* (2013.01); *C23C 2222/10* (2013.01); *C25D 11/246* (2013.01)

(58) Field of Classification Search

CPC ..... C23C 2222/10; C23C 22/82; C23C 22/83; C23C 22/48; C23C 22/56

USPC ..... 148/265, 275

See application file for complete search history.

(56) References Cited

U.S. PATENT DOCUMENTS

| | | | | |
|---|---|---|---|---|
| 3,969,152 | A * | 7/1976 | Melotik | C23C 22/83 148/252 |
| 5,304,257 | A | 4/1994 | Pearlstein et al. | |
| 5,374,347 | A | 12/1994 | Pearlstein et al. | |
| 6,248,184 | B1 | 6/2001 | Dull et al. | |
| 2007/0187001 | A1* | 8/2007 | Kramer | C23C 22/34 148/247 |
| 2011/0159315 | A1* | 6/2011 | Saito | C09D 5/084 428/699 |
| 2011/0165426 | A1* | 7/2011 | Watanabe | C23C 2/06 428/446 |
| 2011/0300390 | A1 | 12/2011 | Morris | |

FOREIGN PATENT DOCUMENTS

| | | | |
|---|---|---|---|
| WO | 2006088519 | A2 | 8/2006 |

OTHER PUBLICATIONS

Pearlstein et al., "Trivalent Chromium Solutions for Applying Chemical Conversion Coatings to Aluminum Alloys or for Sealing Anodized Aluminum", Plating and Surface Finishing, Jul. 1, 1994, pp. 50-55, vol. 81, No. 7, American Electroplaters Society, Inc. East Orange.

* cited by examiner

*Primary Examiner* — Lois L Zheng
(74) *Attorney, Agent, or Firm* — Im IP Law; C. Andrew Im

(57) ABSTRACT

A method for surface treatment of a part made of aluminum, magnesium, or one of the alloys thereof, to protect the part from corrosion. The method comprises consecutively immersing the part in a first aqueous bath containing a corrosion-inhibiting metal salt and an oxidizing compound, and a second aqueous bath containing an oxidizing compound and a corrosion-inhibiting rare-earth salt. The method can be carried out for the chemical conversion of aluminum or the alloys thereof, and of magnesium or the alloys thereof, on parts that have not been previously treated, or after anodizing the part to seal the anodic layer.

32 Claims, No Drawings

METHOD FOR THE SURFACE TREATMENT OF PARTS MADE OF AN ALUMINUM OR MAGNESIUM ALLOY

RELATED APPLICATIONS

This application is a § 371 application from PCT/EP2013/052701 filed Feb. 11, 2013, which claims priority from French Patent Application No. 12 51268 filed Feb. 10, 2012, each of which is herein incorporated by reference in its entirety.

TECHNICAL FIELD OF THE INVENTION

The present invention relates to the field of surface treatment of parts made of aluminum-based light alloys, aluminum alloy, magnesium or magnesium alloy, in order to endow them with corrosion protection. More particularly, it relates to a method for the surface treatment of parts made of aluminum or of magnesium or of a respective alloy thereof.

BACKGROUND OF THE INVENTION

Depending on the use for which they are intended, parts made on the basis of aluminum alloy or of magnesium alloy must undergo operations of surface treatment, in order to increase their corrosion resistance. This applies in particular to parts intended for use in the aeronautical industry, which must meet stringent requirements, notably in terms of performance in the salt spray test.

There are at present several techniques for surface treatment of parts made of aluminum alloy, allowing their properties of corrosion resistance to be increased. One of these techniques is the treatment of chemical conversion of aluminum alloy. The commonest of these methods, known by its trade name "Alodine® 1200" of the company Henkel, performs a chromatizing treatment. For this purpose it employs a substance based on hexavalent chromium. This method is able to endow aluminum alloy with good corrosion resistance, while ensuring that the part has the ability to conduct electricity, by forming a complex surface layer composed principally of hydroxides and oxyhydroxides of chromium and of aluminum on the part, but it gives rise to an environmental problem. Substances based on hexavalent chromium have in fact proved to be toxic to living organisms.

Another technique used conventionally for significantly improving the corrosion resistance of parts made of aluminum alloy implements an anodizing step, followed by one or more sealing steps, i.e. of blocking or closing-up the pores present in the porous anodic layer created on the surface of the part by the anodizing step. There are several types of this. The commonest, employed to obtain a large increase in the corrosion resistance of the parts, notably in order to meet the requirements of the aeronautical sector, consists of chromic anodic oxidation, followed by hydrothermal sealing based on potassium dichromate. Once again, in these various steps, this method thus employs a substance based on hexavalent chromium, which is dangerous to health.

Regarding parts made of magnesium alloy, there are also at present several techniques of surface treatment for increasing their properties of corrosion resistance. One of these techniques is the treatment of chemical conversion of magnesium alloy. The commonest of these methods, known by the designation mordanting, carries out a chromatizing treatment. For this purpose it employs a substance based on hexavalent chromium. This method makes it possible to endow magnesium alloy with good corrosion resistance, by forming a complex surface layer composed principally of hydroxides and oxyhydroxides of chromium and of magnesium on the part, but it too gives rise to an environmental problem, for the same reasons as were expressed above.

Moreover, methods have been proposed in the prior art, notably illustrated by the documents U.S. Pat. No. 5,304,257, U.S. Pat. No. 5,374,347 or else WO 2006/088519, for surface treatment of parts made of aluminum comprising immersing the part in two successive baths, i.e. a first bath containing a metal-salt corrosion inhibitor other than a hexavalent chromium salt, and an oxidizing compound, and a second bath containing an oxidizing compound. The corrosion resistance of the parts thus treated does not, however, prove satisfactory, and it is notably less than that obtained by the treatments using hexavalent chromium.

OBJECT AND SUMMARY OF THE INVENTION

The present invention aims to remedy the drawbacks of the methods of surface treatment of parts made of aluminum alloy or of magnesium alloy with a view to increasing their corrosion resistance, such as are proposed in the prior art, notably those described above, by proposing a method of this kind that does not employ any substance that is toxic to living organisms, and notably hexavalent chromium, while displaying performance, in terms of protection of the parts against oxidation, which is at least equivalent to the methods of the prior art that use substances based on hexavalent chromium.

The present inventors have now developed a method for the surface treatment of parts made of aluminum alloy or of magnesium alloy, which makes it possible to achieve these objectives, whether it is employed either as an alternative to the existing methods of chemical conversion, on bare parts not previously treated, or as an alternative to the existing methods of sealing, on parts that have previously undergone any type of anodizing.

Thus, according to the present invention, a method is proposed for the surface treatment of a part made of aluminum or of magnesium or of one of their respective alloys, i.e. of aluminum alloy or of magnesium alloy, which comprises immersing the part successively in:

- a first aqueous bath containing a metal-salt corrosion inhibitor, excluding a hexavalent chromium salt, and an oxidizing compound,
- and a second aqueous bath containing an oxidizing compound and a rare-earth-salt corrosion inhibitor.

In the present description, corrosion inhibitor means an element which, present at low concentration in a coating formed on a part, slows or stops the process of corrosion of the part in contact with a corrosive medium.

In some embodiments of the invention, the metal salt present in the first bath is a salt of a transition metal that is a corrosion inhibitor. A transition metal is defined here conventionally per se, as a metal in block d of the periodic table, with the exception of lutetium and lawrencium.

The metal-salt corrosion inhibitor may be for example a salt of zinc, manganese, yttrium, zirconium, molybdenum, copper, iron, vanadium, titanium, palladium, silver, gold, nickel, cobalt, chromium, platinum, etc. This salt may notably be a sulfate, a chloride, a nitrate, a fluoride, an acetate, etc. The trivalent chromium salts are particularly preferred in the context of the invention. In the present description, trivalent chromium means, conventionally per se, chromium in the +3 oxidation state. Hexavalent chromium means chromium in the +6 oxidation state.

Advantageously, in terms of performance of the treatment for the corrosion resistance of the part, the second bath comprises, besides an oxidizing compound, a rare-earth-salt corrosion inhibitor. The rare earths are defined here conventionally per se, and include the fifteen lanthanides, scandium and yttrium.

The rare-earth-salt corrosion inhibitor may be for example a salt of lanthanides such as of cerium, lanthanum, praseodymium, neodymium, promethium, samarium, europium, gadolinium, terbium, dysprosium, holmium, erbium, thulium, ytterbium, lutetium; a scandium salt; or an yttrium salt. This salt may notably be a sulfate, a chloride, a nitrate, a fluoride, an acetate, etc. The cerium salts, which may be in the +4 oxidation state, and preferably in the +3 oxidation state, in particular in the form of nitrate, are particularly preferred in the context of the invention, as well as the lanthanum salts.

The substances based on chromium in a +3 oxidation state, as well as the cerium salts and the lanthanum salts, in particular, advantageously, are not harmful to the environment or to health.

Such a method advantageously makes it possible to form on the surface of the part a layer of oxides/hydroxides containing a metal derived from the metal salt present in the first bath, for example trivalent chromium, and a rare earth derived from the rare-earth salt present in the second bath, for example cerium or lanthanum. This layer has excellent properties of corrosion resistance, and thus effectively protects the part against corrosion. In particular, the succession of steps of immersion in each of the first bath and of the second bath, each inducing a chemical conversion of the material on the surface of the part, makes it possible to obtain a synergistic effect, which leads, unexpectedly, to properties of corrosion resistance of the part far superior to those obtained by immersion in just one of these baths, or in two successive baths where the second only contains an oxidizing compound, or only contains a rare-earth-salt corrosion inhibitor. These properties notably make it possible to meet the requirements of the aeronautical sector. The conversion layer obtained on the surface of the part moreover makes it possible, advantageously, to ensure electrical conduction, and it also constitutes a good substrate for bonding of the paint systems used notably in the aeronautical sector. The adherence of conventional paint systems on the surface layer formed on the part by the method according to the invention is notably as good as that obtained for the parts treated by the methods of the prior art using hexavalent chromium.

In some embodiments of the invention, one or more steps of rinsing of the part, for example with water, are carried out between immersion in the first bath and immersion in the second bath.

Both in the first bath and in the second bath, the oxidizing compound may be of any type known per se for the baths for chemical conversion of aluminum or of magnesium or of their respective alloys. Compounds that do not have a harmful effect on the environment are particularly preferred in the context of the invention.

Regarding the first bath, any compound able to activate the surface of the part by dissolving the natural passivation layer and the substrate, leading to a local increase in pH and consequently precipitation in the form of oxides/hydroxides of the active compounds, i.e. of the metal derived from the metal salt of the first bath, for example trivalent chromium, and of the metal constituting the part, comes within the scope of the present invention. Nonlimiting examples of such oxidizing compounds are substances based on fluorides, such as ammonium fluoride or potassium fluorozirconate $K_2ZrF_6$, on permanganate, such as potassium permanganate, on hydrogen peroxide $H_2O_2$, etc. The concentration of oxidizing compound in the first bath may notably be between 0.1 and 50 g/L.

The metal-salt corrosion inhibitor and the oxidizing compound present in the first bath may consist of two different compounds, or of one and the same compound that is able to provide, on its own, the two functions of inhibition of corrosion and of oxidation, for example trivalent chromium fluoride $CrF_3$.

Regarding the second bath, the oxidizing compound is selected to be able to oxidize the surface of the part, thus leading to its own simultaneous reduction, with, once again, local increase in pH and precipitation of oxides/hydroxides of rare earth/trivalent chromium/metal constituting the part. Nonlimiting examples of such oxidizing compounds are substances based on fluorides, such as ammonium fluoride or potassium fluorozirconate $K_2ZrF_6$, on permanganate, such as potassium permanganate, on hydrogen peroxide $H_2O_2$, etc.

According to particular embodiments, the invention moreover presents the following characteristics, implemented separately or in each of their technically operative combinations.

The trivalent chromium salt may be used in any form conventional per se for treatments of chemical conversion of metallic substrate, notably in the form of fluoride, chloride, nitrate, acetate, acetate hydroxide, sulfate, potassium sulfate, etc., of trivalent chromium, for example $CrF_3,xH_2O$, $CrCl_3$, $xH_2O$, $Cr(NO_3)_3,xH_2O$, $(CH_3CO_2)_2Cr,xH_2O$, $(CH_3CO_2)_7Cr_3(OH)_2,xH_2O$, $Cr_2(SO_4)_3,xH_2O$, $CrK(SO_4)_2,xH_2O$, etc.

In preferred embodiments of the invention, the trivalent chromium salt present in the first bath is selected from the fluorides and the sulfates. It is for example chromium trifluoride $CrF_3$, chromium potassium sulfate $CrK(SO_4)_2$, or chromium sulfate $Cr_2(SO_4)_3$.

In some embodiments of the invention, the step of immersion in the first bath corresponds to one or more of the following operating parameters:

- the temperature of the first bath is between 10 and 80° C., preferably between 20 and 50° C., for example equal to 40° C.;
- the pH of the first bath is between 1 and 7, preferably between 2 and 5, for example equal to 3.5;
- the duration of immersion in the first bath is between 1 and 60 minutes, preferably between 5 and 30 minutes, and preferably between 10 and 20 minutes;

The concentration of metal salt, for example of trivalent chromium salt, in the first bath is preferably between 0.5 and 50 g/L, preferably between 1 and 20 g/L.

Particularly preferred compositions of the first bath employ potassium fluorozirconate $K_2ZrF_6$ as oxidizing compound, and correspond to the following respective compositions:

- $CrF_3,4H_2O$ at a concentration between 0.5 and 50 g/L, preferably between 1 and 20 g/L, preferably equal to 6 g/L; and $K_2ZrF_6$ at a concentration between 0.1 and 30 g/L, preferably between 0.5 and 10 g/L, preferably equal to 1 g/L;
- or $CrK(SO_4)_2,6H_2O$ at a concentration between 0.5 and 50 g/L, preferably between 1 and 20 g/L, preferably equal to 2 g/L; and $K_2ZrF_6$ at a concentration between 0.5 and 50 g/L, preferably between 1 and 20 g/L, preferably equal to 5 g/L;

or $Cr_2(SO_4)_3,xH_2O$ at a concentration between 0.5 and 50 g/L, preferably between 1 and 20 g/L, preferably equal to 2 g/L; and $K_2ZrF_6$ at a concentration between 0.5 and 50 g/L, preferably between 1 and 20 g/L, preferably equal to 2 g/L.

Cerium or lanthanum that may be present in the second bath preferably has a +3 oxidation state. The cerium or lanthanum salt may be used in any form, notably chloride, fluoride, nitrate, sulfate, acetate, etc., of cerium, for example $CeCl_3,xH_2O$, $CeF_3,xH_2O$, $Ce(NO_3)_3,xH_2O$, $Ce_2(SO_4)_3,xH_2O$, $Ce(CH_3CO_2)_3,xH_2O$, etc.; or of lanthanum, for example $LaCl_3,xH_2O$, $LaF_3,xH_2O$, $La(NO_3)_3,xH_2O$, $La_2(SO_4)_3,xH_2O$, $La(CH_3CO_2)_3,xH_2O$, etc.

In preferred embodiments of the invention, the rare-earth salt present in the second bath is cerium nitrate $Ce(NO_3)_3$ or lanthanum nitrate $La(NO_3)_3$.

In some embodiments of the invention, the step of immersion in the second bath corresponds to one or more of the following operating parameters:

- the temperature of the second bath is between 10 and 80° C., preferably between 15 and 40° C., and more preferably between 20 and 30° C.;
- the pH of the second bath is between 1 and 7, preferably between 2 and 5, for example equal to 3 or 3.5;
- the duration of immersion in the second bath is between 1 and 60 minutes, preferably between 2 and 20 minutes, and preferably between 5 and 10 minutes.

The concentration of rare-earth salt, notably of cerium or lanthanum salt, in the second bath is between 0 and 50 g/L, preferably between 1 and 10 g/L, for example equal to 5 g/L.

A particularly preferred composition for the second bath employs hydrogen peroxide $H_2O_2$ as oxidizing compound, and corresponds to one of the following compositions: $Ce(NO_3)_3,6H_2O$ or $La(NO_3)_3,6H_2O$, at a concentration between 0.1 and 50 g/L, preferably between 1 and 10 g/L, preferably equal to 5 g/L, and $H_2O_2$, solution at 35% v/v, at a concentration between 5 and 500 mL/L, preferably between 5 and 200 mL/L, more preferably between 10 and 100 mL/L, preferably equal to 50 mL/L.

More generally, when the oxidizing compound selected for the second bath is hydrogen peroxide $H_2O_2$, the latter is incorporated in the form of an aqueous solution for example at 35% v/v or at 30% v/v, to obtain a concentration in the bath between 5 and 500 ml/l, preferably between 5 and 200 mL/L, more preferably between 10 and 100 mL/L, and preferably equal to 50 mL/L.

In some embodiments of the invention, the part undergoes a step of anodizing treatment prior to its immersion in the first bath and the second bath. The invention is then also expressed in terms of a method of post-anodizing sealing. The preliminary step of anodizing treatment may be applied by any method known per se. Preferably, it does not use any substance based on hexavalent chromium. Particularly preferred, in the context of the invention, are anodizing processes of the sulfuric anodizing type, diluted or not, such as standard sulfuric anodic oxidation (called OAS standard), diluted sulfuric anodic oxidation (called OAS dilute), sulfo-tartaric anodic oxidation (OAST), sulfo-boric anodic oxidation (OASB), etc. These methods are well known by a person skilled in the art.

In particular embodiments of the invention, the part undergoes a step of degreasing and/or pickling prior to its immersion in the first bath and the second bath, so as to remove grease, dirt and oxides present on its surface. In the case when the method comprises a step of anodizing treatment, this step of surface preparation by degreasing and/or pickling is advantageously carried out before anodizing.

More particularly, the preliminary step of surface preparation may comprise one or more of the following operations:

- solvent degreasing, to dissolve grease present on the surface of the part. This operation may be carried out by dipping, spraying, or any other technique known per se. It may for example be carried out by dipping in Methoklone or acetone, at a temperature below 42° C., for a time between 5 seconds and 3 minutes;
- alkaline degreasing, to dissolve grease present on the surface of the part. This operation may be carried out by dipping, spraying, or any other technique known per se. It may for example be carried out by dipping in a mixture of TURCO 4215 NCLT at 40 to 60 g/L, and of TURCO 4215 additive at 5 to 20 g/L, marketed by the company HENKEL, at a temperature between 50 and 70° C., for a time between 10 and 30 minutes;
- alkaline pickling, to dissolve the oxides formed naturally on the surface of the part. This operation may be carried out by dipping, spraying, or any other technique known per se. It may for example be carried out by dipping in a solution of sodium hydroxide at 30 to 70 g/L, at a temperature between 20 and 60° C., for a time between 10 seconds and 2 minutes. At the end of this operation, the part is covered with a pulverulent layer formed from products of oxidation of the intermetallic compounds, which should be removed by a step of acid pickling;
- acid pickling, to dissolve the oxides formed naturally on the surface of the part and/or the oxidation layer formed on the surface of the part during the step of alkaline pickling. This operation may be carried out by dipping, spraying, or any other technique known per se. It may for example be carried out by dipping in a solution of SMUT-GO NC at 15 to 25% v/v, marketed by the company HENKEL, at a temperature between 10 and 50° C., for a time between 1 and 10 minutes; or by dipping in a solution of ARDROX 295GD at 15 to 30% v/v, marketed by the company CHEMETALL, at a temperature between 10 and 30° C., for a time between 1 and 10 minutes.

Interposed rinsings, notably with water, are preferably carried out between the successive steps mentioned above, and before immersing the part in the first bath.

When the method does not comprise an anodizing step, the invention is expressed in terms of a method of chemical conversion of aluminum or an aluminum alloy, or of magnesium or a magnesium alloy.

DETAILED DESCRIPTION OF THE EMBODIMENTS

The features and advantages of the method according to the invention will become clearer from the embodiment examples given below, supplied purely for purposes of illustration and not limiting the invention in any way.

Example 1—Treatment of Chemical Conversion of Parts Made of Aluminum Alloy 1.1. Methods of Treatment Parts made of rolled aluminum alloy 2024 T3, with dimensions of 120×80×2 mm, are treated as follows.

Steps of surface preparation of each part are first carried out successively:

alkaline degreasing, by dipping the part in a mixture of TURCO 4215 NCLT at 50 g/L and TURCO 4215 additive at 10 g/L, at a temperature of 60° C., for 20 min;

water rinsings;

acid pickling, by dipping the part in a solution of SMUT-GO NC at 19% v/v, at a temperature of 20° C., for 5 min;

water rinsings.

The parts are then submitted to successive immersions in the following first aqueous bath, and respectively in one of the following second aqueous baths.

The first bath, based on trivalent chromium, called Bath 1, corresponds to the composition: $CrK(SO_4)_2,6H_2O$ at 2 g/L+ $K_2ZrF_6$ at 5 g/L, in water.

Its pH is fixed at 3.5, and its temperature is adjusted to 40° C.

The duration of immersion in this first bath is equal to 10 min.

The second aqueous bath, called Bath 2, corresponds to one of the compositions shown in Table 1 below. Three of these baths, comprising an oxidizing compound and a rare-earth salt, respectively of cerium (baths D1 and D2) or of lanthanum (bath D3) are according to the present invention, and two of them, Comp.1 and Comp.2, constitute comparative examples.

TABLE 1

Compositions of the second aqueous baths (Bath 2)

| Bath | Oxidizing compound | Rare-earth salt | pH |
|---|---|---|---|
| D1 | $H_2O_2$, 35% v/v, 50 mL/L | $Ce(NO_3)_3$, $6H_2O$ 5 g/L | 3 |
| D2 | $H_2O_2$, 35% v/v, 50 mL/L | $Ce(NO_3)_3$, $6H_2O$ 5 g/L | 3.5 |
| D3 | $H_2O_2$, 35% v/v, 50 mL/L | $La(NO_3)_3$, $6H_2O$ 5 g/L | 3.5 |
| Comp. 1 | $H_2O_2$, 35% v/v, 50 mL/L | — | 3.5 |
| Comp. 2 | — | $Ce(NO_3)_3$, $6H_2O$ 5 g/L | 3.5 |

The temperature of each of these baths is room temperature, i.e. a temperature between about 18 and 25° C. The duration of immersion in each of these second baths is equal to 5 min.

Some parts are also treated, after surface preparation, by immersion only in Bath 1 described above.

As other comparative examples, identical parts, having undergone an identical surface preparation, are treated by the following commercial methods of chemical conversion proposed in the prior art: Alodine® 1200 (Henkel) (using hexavalent chromium), SurTec® 650 (SurTec) (using trivalent chromium), and Lanthane® VS 613.3 (Coventya) (using trivalent chromium).

The operating conditions for these comparative examples are shown in Table 2 below.

TABLE 2

Operating conditions of methods of chemical conversion of the prior art

| Method | Concentration in the bath | Temperature (° C.) | pH | Duration of immersion in the bath (min) |
|---|---|---|---|---|
| Alodine ® 1200 | 15 g/L | 20 | 1.8 | 1 |
| SurTec ® 650 | 20% v/v | 40 | 3.9 | 4 |
| Lanthane ® VS 613.3 | Part A 100 ml/L Part B 75 ml/L | 38 | 3.5 | 5 |

1.2. Corrosion Resistance Tests

All of the parts thus treated are submitted to a salt spray test according to standard ISO 9227. Preliminary approximate average results, obtained on a small number of parts, are shown in Table 3 below.

TABLE 3

Salt spray durability of parts made of rolled aluminum alloy 2024 T3 treated by a method according to an embodiment of the invention and by methods of chemical conversion of the prior art

| Method of treatment | Salt spray durability (appearance of the 1st corrosion pit) (h) |
|---|---|
| Alodine ® 1200 | 168 |
| SurTec ® 650 | 48 |
| Lanthane ® VS 613.3 | 72 |
| Immersion in Bath 1 only | 96 |
| Immersion in Bath 1 and then bath D1 according to an embodiment of the invention | 408 |

More precise average results for appearance of the first corrosion pit and generalized corrosion, obtained on a larger number of parts (30 parts treated similarly), are shown in Table 4 below.

TABLE 4

Salt spray durability, in terms of appearance of the first corrosion pit and generalized corrosion, of parts made of rolled aluminum alloy 2024 T3 treated by a method according to an embodiment of the invention and by methods of chemical conversion of the prior art

| Method of treatment | Salt spray durability (h) | |
|---|---|---|
| | Appearance of the 1st corrosion pit | Generalized corrosion |
| Alodine ® 1200 | 168 | 240 |
| SurTec ® 650 | 24 | 48 |
| Lanthane ® VS 613.3 | 48 | 72 |
| Immersion in Bath 1 only | 48 | 96 |
| Immersion in Bath 1 and then in bath Comp. 1 | 120 | 192 |
| Immersion in Bath 1 and then in bath Comp. 2 | 96 | 144 |
| Immersion in Bath 1 and then in bath D1 (cerium) | 192 | 288 |
| Immersion in Bath 1 and then in bath D2 (cerium) | 192 | 288 |
| Immersion in Bath 1 and then in bath D3 (lanthanum) | 216 | 312 |

The above results clearly show that the methods according to the invention, using trivalent chromium, are able to endow the treated part with corrosion resistance greater than that obtained by the conventional methods of chemical conversion, including that using hexavalent chromium (Alodine® 1200). This resistance is also far greater than that conferred by a treatment only envisaging immersion of the part in the first bath, and not in the second, as well as that conferred by a treatment in which the second bath is without rare-earth salt (Comp.1), or without oxidizing compound (Comp.2).

1.3. Test of Adherence of Paint Systems

A test of adherence of conventional paint systems on the conversion layer formed on the part, on the one hand by an aforementioned method according to the invention, comprising immersing the part in Bath 1 and then in Bath 2 designated D1 (cerium salt), and on the other hand by the method of the prior art Alodine® 1200, is carried out as follows.

Two paint systems are tested: a water-dilutable epoxy-based system (P60+F70) and a solvent-treated polyurethane-based system (PAC33+PU66). The tests are carried out according to standard ISO 2409, for dry adherence, after drying of the paint system, and for wet adherence: after drying of the paint system, the samples are immersed in demineralized water for 14 days, and then dried before undergoing the adherence test according to the standard.

The results are shown in Table 5 below.

TABLE 5

Results of tests of adherence of two paint systems on parts treated by a method according to one embodiment of the invention or by a method of chemical conversion of the prior art

| Paint system | | Alodine ® 1200 | | Method according to the invention (Bath 1 then Bath 2 D1) | |
|---|---|---|---|---|---|
| | | Dry adherence | Wet adherence | Dry adherence | Wet adherence |
| Solvent-treated base | PAC33 | Grade 0 | — | Grade 0 | — |
| | PAC33 + PU66 | Grade 0 | Grade 0 | Grade 0 | Grade 0 |
| Water-dilutable base | P60 | Grade 0 | — | Grade 0 | — |
| | P60 + F70 | Grade 0 | Grade 0 | Grade 0 | Grade 0 |

These results show that the parts treated by the method according to an embodiment of the invention display adherence of the paint systems, whether of the water-dilutable or solvent-treated type, comparable to that obtained for the parts treated by the method of the prior art Alodine® 1200.

1.4. Test of Electrical Conductivity of the Layer Formed on the Surface of the Part by the Method of Treatment The parts treated by the method according to the invention, comprising immersing the part in Bath 1 and then in Bath 2 designated D1 (cerium salt), are submitted to a test of electrical conductivity according to standard MIL-DTL-81760B, which consists of measuring the resistivity of the layer/substrate/layer system.

As comparative examples, parts treated by the commercial method of chemical conversion proposed in the prior art Alodine® 1200, as described in Table 2 above ("Alodine® 1200 thick layer"), as well as parts treated by the same method of chemical conversion Alodine® 1200, but comprising immersion in the treatment bath for 30 seconds only ("Alodine® 1200 thin layer"), are also submitted to the same test.

According to the prior art, the thick layer of Alodine® 1200 is recommended when good properties of corrosion resistance are required, at the expense of the properties of electrical conduction. Conversely, the thin layer of Alodine® 1200 is recommended when good properties of electrical conduction are required, but with a halving of the anticorrosion performance of the treatment.

The results obtained are shown in Table 6 below.

TABLE 6

Results of tests of electrical conductivity on parts treated by a method according to an embodiment of the invention or by methods of chemical conversion of the prior art

| | Resistivity of the layer (mΩ) |
|---|---|
| Alodine ® 1200 thin layer | 59 |
| Alodine ® 1200 thick layer | 84 |
| Method according to the invention (Bath 1 then Bath 2 D1) | 69 |

These results show that the layer formed on the part by the method according to the invention has good properties of electrical conduction, close to those obtained by the method Alodine® 1200 thin layer of the prior art.

The method according to the invention thus makes it possible to form a layer on the part that advantageously combines performance of corrosion protection better than that obtained by the method of the prior art Alodine® 1200 thick layer, with good electrical conductivity.

Example 2—Treatment of Chemical Conversion of Parts Made of Aluminum Alloy

Several operating parameters of the method according to the invention are varied relative to the above Example 1.

2.1. Variants of Oxidizing Compounds in Bath 2

Parts made of aluminum similar to those used for Example 1 are submitted to the preliminary steps of surface preparation described in Example 1.

These parts are then submitted to a first immersion in the following Bath 1: $CrK(SO_4)_2,6H_2O$ at 2 g/L+$K_2ZrF_6$ at 5 g/L, in water, pH=3.5, temperature=40° C.; the duration of immersion in this first bath is 10 min.

They are then submitted to immersion in a Bath 2 according to the invention, more particularly either in bath D1 described above, or in an aqueous bath D4 of composition: $Ce(NO_3)_3,6H_2O$ at 5 g/L; $KMnO_4$ at 10 ml/l in water; pH=3.

For each of these methods, the temperature is room temperature, and the duration of immersion in Bath 2 is 5 min.

The parts thus treated are submitted to a salt spray test according to standard ISO 9227. The results obtained are shown in Table 7 below.

TABLE 7

Salt spray durability, in terms of appearance of the first corrosion pit and generalized corrosion, of parts made of rolled aluminum alloy 2024 T3 treated by two variants of methods according to the invention

| | Salt spray durability (h) | |
|---|---|---|
| | Appearance of the 1st corrosion pit | Generalized corrosion |
| Bath 1 then bath D1 | 240 | 336 |
| Bath 1 then bath D4 | 216 | 312 |

It can be seen from these results that the method according to the invention, using potassium permanganate as oxidizing compound in the 2nd bath, displays, just as when this oxidizing compound is hydrogen peroxide, very high performance in terms of corrosion protection of the treated parts.

2.2. Variants of Trivalent Chromium Salts in Bath 1

Parts made of aluminum similar to those used for Example 1 are submitted to the preliminary steps of surface preparation described in Example 1.

These parts are then submitted to a first immersion, for 10 min, in the Baths 1 indicated in Table 8 below, whose pH is fixed at 3.5 and the temperature is adjusted to 40° C.

TABLE 8

Composition of the first aqueous baths (Bath 1)

| Bath 2 | Metal salt | Oxidizing compound |
|---|---|---|
| P1 | $CrF_3$, $4H_2O$ at 6 g/l | $K_2ZrF_6$ at 1 g/l |
| P2 | $CrK(SO_4)_2$, $6H_2O$ at 2 g/l | $K_2ZrF_6$ at 5 g/l |
| P3 | $Cr_2(SO_4)_3$ at 2 g/l | $K_2ZrF_6$ at 1 g/l |

Each part is then immersed in Bath 2 according to the invention D1 described above, at room temperature, for 5 min.

The parts thus treated are submitted to a salt spray test according to standard ISO 9227. The results obtained are shown in Table 9 below.

TABLE 9

Salt spray durability, in terms of appearance of the first corrosion pit and generalized corrosion, of parts made of rolled aluminum alloy 2024 T3 treated by three variants of methods according to the invention

| | Salt spray durability (h) | |
|---|---|---|
| | Appearance of the 1st corrosion pit | Generalized corrosion |
| Bath P1 then bath D1 | 216 | 312 |
| Bath P2 then bath D1 | 240 | 360 |
| Bath P3 then bath D1 | 240 | 336 |

It can be seen from these results that the method according to the invention gives high performance in terms of corrosion protection of the treated parts whatever the trivalent chromium salt used in the 1st bath.

Example 3—Treatment of Chemical Conversion of Parts Made of Magnesium Alloy

A part made of extruded magnesium alloy Elektron 21, with dimensions of 120×80×6 mm, is treated as follows.

Steps of surface preparation of the part are first carried out successively:

- alkaline degreasing, by dipping the part in a mixture of $Na_3PO_4$ at 20 g/L and of $Na_2CO_3$ at 40 g/L, at a temperature of 60° C., for 10 min;
- water rinsings;
- acid pickling, by dipping the part in a solution of nitric acid at 50 g/L, at a temperature of 30° C., for 40 seconds;
- water rinsings.

The part is then immersed successively in the following first and second aqueous baths.

The first bath, based on trivalent chromium, called Bath 1, corresponds to the composition:

$CrK(SO_4)_2,6H_2O$ at 2 g/L+$K_2ZrF_6$ at 5 g/L, in water.

Its pH is fixed at 3.5, and its temperature is adjusted to 40° C.

The duration of immersion in this first bath is 10 min.

The second bath, based on cerium, called Bath 2, corresponds to the composition: $Ce(NO_3)_3,6H_2O$ at 5 g/L; $H_2O_2$, solution at 35% v/v, 50 mL/L, in water.

Its pH is fixed at 3, and its temperature is room temperature, i.e. a temperature between about 18 and 25° C.

The duration of immersion in this second bath is 5 min.

As a comparative example, identical parts, having undergone identical surface preparation, are treated by a method of chemical conversion proposed in the prior art: Mordançage® ["Mordanting"] (using hexavalent chromium), carried out in the following conditions:

- composition: $K_2Cr_2O_7$ at 40 g/L+$KCr(SO_4)_2,12H_2O$ at 2.2 g/L+KOH at 2 g/L
- temperature: 75° C.
- duration of immersion: 5 min.

All of the parts thus treated are submitted to a salt spray test according to standard ISO 9227. Preliminary approximate average results, obtained on a small number of parts, are shown in Table 10 below.

TABLE 10

Salt spray durability of parts in extruded magnesium alloy Elektron 21 treated by a method according to an embodiment of the invention and by a method of chemical conversion of the prior art

| | Salt spray durability (appearance of the 1st corrosion pit) (h) |
|---|---|
| Mordançage ® | 24 |
| Immersion in Bath 1 and then Bath 2 according to an embodiment of the invention | 48 |

More precise average results relating to appearance of the first corrosion pit and generalized corrosion, obtained on a larger number of parts (30 parts treated similarly), are shown in Table 11 below.

TABLE 11

Salt spray durability, in terms of appearance of the first corrosion pit and generalized corrosion, of parts in extruded magnesium alloy Elektron 21 treated by a method according to an embodiment of the invention and by a method of chemical conversion of the prior art

| | Salt spray durability (h) | |
|---|---|---|
| | Appearance of the 1st corrosion pit | Generalized corrosion |
| Mordançage ® | 4 | 24 |
| Immersion in Bath 1 and then Bath 2 according to an embodiment of the invention | 7 | 48 |

The above results show that the method according to an embodiment of the invention, using trivalent chromium, makes it possible, for magnesium alloy just as for aluminum alloy in Example 1 above, to endow the treated part with corrosion resistance far greater than that obtained by the conventional method of chemical conversion.

Example 4—Anodizing and Sealing Treatment of Parts Made of Aluminum Alloy

Parts made of rolled aluminum alloy 2024T3 with dimensions of 120×80×2 mm are treated by anodizing, then sealing, according to the methods given below.

They first undergo steps of surface preparation, by alkaline degreasing and acid pickling, as indicated in Example 1 above.

For the anodizing step, three different methods of anodizing, namely OAS dilute, OAST and OASB, are used, to obtain an anodic layer of thickness from 2 to 5 μm on the surface of the parts.

The operating parameters for OAS dilute, OAST and OASB are shown in Table 12 below.

TABLE 12

Operating parameters employed for the different anodizing steps

| | OAS dilute | OAST | OASB |
|---|---|---|---|
| Bath composition | $H_2SO_4$: 62 g/L | $H_2SO_4$: 40 g/L<br>$C_4H_6O_6$: 80 g/L | $H_2SO_4$: 45 g/L<br>$H_3BO_3$: 8 g/L |
| Bath temperature (° C.) | 22 | 37 | 27 |
| Voltage cycle | 14 V - 24 min | 14 V - 25 min | 15 V - 23 min |

At the end of the anodizing step, the parts obtained are submitted to a sealing step, either of the hydrothermal type, or of the hydrothermal type with nickel salts, or by the method according to the invention carried out in the conditions indicated in Example 1 above, as regards immersion in Bath 1 and Bath 2.

The operating conditions for hydrothermal sealing and for hydrothermal sealing with nickel salts are as follows:

hydrothermal sealing: immersing the part in demineralized water at a temperature of 98° C. for 40 min;

hydrothermal sealing with nickel salts: immersing the part in demineralized water with addition of nickel acetate $(CH_3COO)_2Ni$ at 10 g/L, at a temperature of 98° C. and a pH of 5.5, for 30 min.

A sealed anodic layer with thickness between 2 and 5 μm is obtained on each treated part.

All of the parts thus treated are submitted to a salt spray test according to standard ISO 9227. Preliminary approximate average results, obtained on a small number of parts, are shown in Table 13 below.

TABLE 13

Salt spray durability of parts made of rolled aluminum alloy 2024 T3 treated by anodizing and sealing, sealing being carried out by a method according to an embodiment of the invention or by methods of sealing of the prior art

| | Salt spray durability (appearance of the 1st corrosion pit) (h) | | |
|---|---|---|---|
| | OAS dilute | OAST | OASB |
| Hydrothermal sealing | 72 | 96 | 48 |
| Hydrothermal sealing with nickel salts | 312 | 336 | 240 |
| Sealing by a method according to the invention | 696 | 744 | 552 |

More precise average results, in terms of appearance of the first corrosion pit ("1st") and generalized corrosion ("$G^{on}$"), obtained on a larger number of parts (30 parts), are shown in Table 14 below.

TABLE 14

Salt spray durability, in terms of appearance of the first corrosion pit ("1st") and generalized corrosion ("$G^{on}$"), of parts made of rolled aluminum alloy 2024 T3 treated by anodizing and sealing, sealing being carried out by a method according to an embodiment of the invention or by methods of sealing of the prior art

| | Salt spray durability (h) | | | | | |
|---|---|---|---|---|---|---|
| | OAS dilute | | OAST | | OASB | |
| | 1st | $G^{on}$ | 1st | $G^{on}$ | 1st | $G^{on}$ |
| Hydrothermal sealing | 72 | 168 | 72 | 192 | 48 | 168 |
| Hydrothermal sealing with nickel salts | 312 | 792 | 336 | 840 | 288 | 744 |
| Sealing by a method according to the invention | 432 | 1272 | 480 | 1344 | 384 | 1128 |

The above results clearly demonstrate that the method according to an embodiment of the invention, using trivalent chromium, carried out after an anodizing step, of whatever type, makes it possible to endow the treated part with corrosion resistance far greater than that obtained by the conventional methods of sealing, regardless of what method of anodizing was carried out beforehand.

The foregoing description clearly illustrates that owing to its various features and their advantages, the present invention achieves the objectives that were set. In particular, it provides a method for the surface treatment of parts made of aluminum or of aluminum alloy, or of magnesium or of magnesium alloy, which, without using hexavalent chromium, makes it possible to obtain performance in terms of protection of the part against corrosion that is superior to that obtained by the methods of the prior art.

The invention claimed is:

1. A method for surface treatment of a part made of aluminum, magnesium or one of their respective alloys, comprising the steps of successively:

immersing the part in a first aqueous bath containing a trivalent chromium salt, excluding a hexavalent chromium salt, and an oxidizing compound; and immersing the part in a second aqueous bath containing an oxidizing compound chosen from a group consisting of substances based on permanganate and hydrogen peroxide, and a rare-earth-salt corrosion inhibitor.

2. The method as claimed in claim 1, wherein a trivalent chromium salt in the first aqueous bath is selected from fluorides.

3. The method as claimed in claim 1, wherein a trivalent chromium salt in the first aqueous bath is selected from sulfates.

4. The method as claimed in claim 1, wherein a temperature of the first aqueous bath is between 10 and 80° C.

5. The method as claimed in claim 1, wherein a temperature of the first aqueous bath is between 20 and 50° C.

6. The method as claimed in claim 1, wherein a pH of the first aqueous bath is between 1 and 7.

7. The method as claimed in claim 1, wherein a pH of the first aqueous bath is between 2 and 5.

8. The method as claimed in claim 1, further comprising the step of immersing the part in the first aqueous bath for a duration between 1 and 60 minutes.

9. The method as claimed in claim 1, further comprising the step of immersing the part in the first aqueous bath for a duration between 5 and 30 minutes.

10. The method as claimed in claim 1, further comprising the step of immersing the part in the first aqueous bath for a duration between 10 and 20 minutes.

11. The method as claim in of claim 1, wherein a concentration of the trivalent chromium salt in the first aqueous bath is between 0.5 and 50 g/L.

12. The method as claim in of claim 1, wherein a concentration of the trivalent chromium salt in the first aqueous bath is between 1 and 20 g/L.

13. The method as claim in claim 1, wherein the rare-earth-salt corrosion inhibitor present in the second aqueous bath is a lanthanum salt.

14. The method as claim in claim 1, wherein the rare-earth salt corrosion inhibitor present in the second aqueous bath is a cerium salt.

15. The method as claim in claim 1, wherein the rare-earth salt corrosion inhibitor present in the second aqueous bath is a cerium salt in the +3 oxidation state.

16. The method as claim in claim 1, wherein the rare-earth salt corrosion inhibitor present in the second aqueous bath is a cerium nitrate.

17. The method as claim in claim 1, wherein a concentration of the rare-earth salt corrosion inhibitor in the second aqueous bath is greater than 0 and less than 50 g/L.

18. The method as claim in claim 1, wherein a concentration of the rare-earth salt corrosion inhibitor in the second aqueous bath is between 1 and 10 g/L.

19. The method as claimed in claim 1, wherein a temperature of the second aqueous bath is between 10 and 80° C.

20. The method as claimed in claim 1, wherein a temperature of the second aqueous bath is between 15 and 40° C.

21. The method as claimed in claim 1, wherein a temperature of the second aqueous bath is between 20 and 30° C.

22. The method as claimed in claim 1, wherein a pH of the second aqueous bath is between 1 and 7.

23. The method as claimed in claim 1, wherein a pH of the second aqueous bath is between 2 and 5.

24. The method as claimed in claim 1, further comprising the step of immersing the part in the second aqueous bath for a duration between 1 and 60 minutes.

25. The method as claimed in claim 1, further comprising the step of immersing the part in the second aqueous bath for a duration between 2 and 20 minutes.

26. The method as claimed in claim 1, further comprising the step of immersing the part in the second aqueous bath for a duration between 5 and 10 minutes.

27. The method as claimed in claim 1, further comprising the step of performing anodizing treatment on the part prior to successively immersing the part in the first aqueous bath and second aqueous bath.

28. The method as claimed in claim 1, wherein the oxidizing compound in said second bath is hydrogen peroxide $H_2O_2$.

29. The method as claimed in claim 1, wherein the immersion is said second bath has a duration of more than 1 min and up to 60 min.

30. The method as claimed in claim 1, further comprising a rinsing step between said first and said second immersion steps.

31. The method as claimed in claim 1, wherein the part is immersed in the second aqueous bath without drying the part after being immersed in the first bath.

32. The method as claimed in claim 1, wherein the rare-earth-salt corrosion inhibitor is chosen from a group consisting of the salts of lanthanum, praseodymium, neodymium, promethium, samarium, europium, gadolinium, terbium, dysprosium, holmium, erbium, thulium, ytterbium, lutetium, scandium and yttrium.

* * * * *